US007905065B2

(12) United States Patent
Powers

(10) Patent No.: US 7,905,065 B2
(45) Date of Patent: Mar. 15, 2011

(54) FASTENER DEVICE

(75) Inventor: Robert W. Powers, Boca Raton, FL (US)

(73) Assignee: Pin2Pin, LLC, Boca Raton, FL (US)

( * ) Notice: Subject to any disclaimer, the term of this patent is extended or adjusted under 35 U.S.C. 154(b) by 0 days.

(21) Appl. No.: 12/557,607

(22) Filed: Sep. 11, 2009

(65) Prior Publication Data

US 2010/0071286 A1 Mar. 25, 2010

Related U.S. Application Data

(62) Division of application No. 11/926,718, filed on Oct. 29, 2007, now Pat. No. 7,712,269.

(51) Int. Cl.
*E06B 3/26* (2006.01)

(52) U.S. Cl. ..... 52/202; 49/61; 49/62; 49/463; 49/50; 49/57

(58) Field of Classification Search ..... 52/202; 49/61, 62, 463, 50, 57, 465
See application file for complete search history.

(56) References Cited

U.S. PATENT DOCUMENTS

| | | | | |
|---|---|---|---|---|
| 103,273 | A | 5/1870 | Morse | |
| 537,088 | A | 4/1895 | Varney | |
| 810,604 | A * | 1/1906 | Baier | 248/208 |
| 2,417,233 | A * | 3/1947 | Buford | 248/208 |
| 2,549,661 | A | 4/1951 | Carney | |
| 2,622,285 | A * | 12/1952 | Roos | 52/202 |
| 2,794,217 | A * | 6/1957 | Croft | 248/200.1 |
| 7,614,187 | B1 * | 11/2009 | Forbes | 52/202 |
| 7,624,548 | B2 * | 12/2009 | Hansen et al. | 52/202 |
| 2005/0039402 | A1 * | 2/2005 | Murphy et al. | 49/57 |
| 3,467,415 | A | 9/1969 | Sandor | |
| 4,467,574 | A * | 8/1984 | Falge et al. | 52/106 |
| 4,817,401 | A * | 4/1989 | Cohodar | 70/58 |
| 5,070,647 | A * | 12/1991 | Spialter | 49/55 |
| 5,487,402 | A | 1/1996 | Clary | |
| 5,507,118 | A * | 4/1996 | Brown | 49/61 |
| 5,673,883 | A * | 10/1997 | Figueroa, Jr. | 248/200.1 |
| 6,003,202 | A | 12/1999 | Dauterive | |
| 6,363,670 | B1 * | 4/2002 | Dewitt | 52/202 |
| 6,393,777 | B1 | 5/2002 | Renfrow | |
| 6,497,077 | B1 * | 12/2002 | Emek | 52/202 |
| 6,532,702 | B1 | 3/2003 | Scribner | |
| 6,532,704 | B2 | 3/2003 | Hart | |
| 6,640,509 | B2 * | 11/2003 | Clewis | 52/202 |
| 7,337,582 | B1 * | 3/2008 | Klotz | 49/465 |

(Continued)

FOREIGN PATENT DOCUMENTS

| | | | |
|---|---|---|---|
| AU | 199513507 | A1 | 9/1995 |
| EP | 0604225 | A1 | 6/1994 |
| FR | 2237485 | | 7/1975 |
| GB | 2275492 | A | 8/1994 |
| GB | 2277548 | A | 11/1994 |

* cited by examiner (Continued)

*Primary Examiner* — Brian E Glessner
*Assistant Examiner* — Joshua Ihezie
(74) *Attorney, Agent, or Firm* — GrayRobinson, P.A.

(57) ABSTRACT

A fastener device for releasably securing an object within an opening formed in a structure comprises a first fastening member and a second fastening member each having a pair of legs which are oriented at an angle relative to one another. A coupling element is movable along one of the legs of at least one of the first and second fastening members. One leg of each fastening member is inserted into a hole formed in the structure surrounding the opening allowing the other leg to pivot, preferably in a trochoidal motion, until the pivoting legs align with one another at which time the coupling element may be moved into engagement with the two pivoting legs to releasably connect the fastening members together in position to secure the object relative to the opening.

38 Claims, 8 Drawing Sheets

FASTENER DEVICE

CROSS REFERENCE TO RELATED APPLICATIONS

This is a divisional of U.S. patent application Ser. No. 11/926,718, filed Oct. 29, 2007 now U.S. Pat. No. 7,712,269, which is expressly incorporated herein by reference in its entirety to form a part of the present disclosure.

FIELD OF THE INVENTION

This invention relates to fastener devices, and, more particularly, to a fastener device capable of releasably securing an object with respect to an opening formed in a structure.

BACKGROUND OF THE INVENTION

The damage to buildings and their contents due to storms, and especially hurricanes, is an ever increasing problem. Doors, windows and other openings in buildings must be secured from wind and rain. Once an opening in a building is breached, wind can enter the interior of the structure and damage or destroy walls, the roof and other parts of the building.

At least two basic approaches to secure openings in buildings are in general use, particularly in areas prone to hurricanes. One approach is to equip doors and windows in the building with "hurricane-resistant" glass, which generally comprises a combination of plastic vinyl layers and polyester film bonded between panes of glass to form a single sheet. Impacts by flying debris and the like from a storm may shatter the outer pane(s) of glass, but the interior plastic layer(s) generally prevent a breach of the opening. While laminated glass products of this type are reasonably effective, they are expensive, they frequently leak and they must be completely replaced, including the frame, if damaged.

The most common approach to securing openings in buildings involves placing a hurricane shutter or some type of panel, such as plywood, over a window, door, etc. to protect against wind, rain and flying debris. There are many types of hurricane shutters, including storm panel shutters, accordion shutters, colonial shutters, bahama-style shutters, roll-down shutters and others. Storm panel shutters come in different forms, but generally comprise a number of corrugated panels formed of metal or plastic which overlap one another and mount within tracks or to bolts affixed to the sides of the window or door opening. Colonial and bahama-style shutters are more aesthetically pleasing, and permanently mount either at the top or along the sides of the opening. Shutters of this type have louvered panels which may be closed, and the shutters secured to the building, during a storm. Accordion hurricane shutters typically comprise one or two groups of pivotally interconnected panels which are movable between a retracted position at one side of the opening, and an extended position to cover the opening.

Shutters of the type described above suffer from various deficiencies. All are relatively expensive and may be deployed in advance of storm with varying degrees of difficulty. Many shutters remain permanently in place on the exterior of a structure and detract from the aesthetics of the building, and require periodic maintenance due to exposure to the elements.

Given the disadvantages of hurricane-resistant glass and shutters, the placement of a panel over doors, windows and other openings is a comparatively inexpensive alternative. However, difficulty arises with the manner in which the panels are mounted in place to the door and window frames, or other openings in a building. In many instances, sheets of plywood or other panels made of similar materials are nailed or screwed to the building structure. This creates unsightly holes which must be filled in and painted over after the storm has passed. Further, nails and screws can be pulled out of place when subjected to high winds, particularly where the panels do not snugly fit the openings and are larger in size, e.g. panels for large doors and windows.

Fastener devices for securing an object such as a panel with respect to door frames, window frames and other openings in a building have been proposed in the past. U.S. Pat. No. 5,507,118 discloses two cross braces which are pivotally connected to one another and mounted to a board sized to fit over the opening of a window. The ends of each brace receive a rod which telescopes in and out of the brace. In order to mount a board over a window opening, the rods at the opposed ends of both cross braces are extended into openings formed in the window frame. French Patent No. 2 237 485 discloses a central telescoping element which supports arms that extends to the four corners of a window or other opening in a building to secure a plastic film over the opening. U.S. Pat. No. 2,549,661 teaches the use of cross braces including a horizontally extending brace and vertically oriented members located on the outside of a window, and at least one horizontal brace and one vertical member positioned on the inside of a window. Rubber strips are located between the horizontal braces and the window pane, and between the vertical members and window pane, to localize the effect of vibratory stresses on the window pane produce by storms.

Each of the fastener devices noted above is relatively complex, expensive, difficult to install and may require tools for installation. Further, such devices do not readily accommodate openings of different size.

SUMMARY OF THE INVENTION

The fastener device of this invention is a simple, inexpensive, easily installed means for securing an object, such as a panel, relative to an opening in a building or other structure having essentially any shape.

In one presently preferred embodiment, the fastener device of this invention comprises a first fastening member and a second fastening member each having a pair of legs which are connected and oriented at an angle relative to one another. A coupling element is carried by one of the legs of at least one of the first and second fastening members, and is movable along that leg. One leg of each fastening member is inserted into a hole formed in the structure surrounding the opening in such a way as to allow the other leg to pivot about the leg located within the hole. The pivoting legs of each fastening member may be moved, preferably undergoing a trochoidal motion, until they align with one another. At that juncture, the coupling element may be moved into engagement with the two pivoting legs to releasably connect the fastening members together.

BRIEF DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
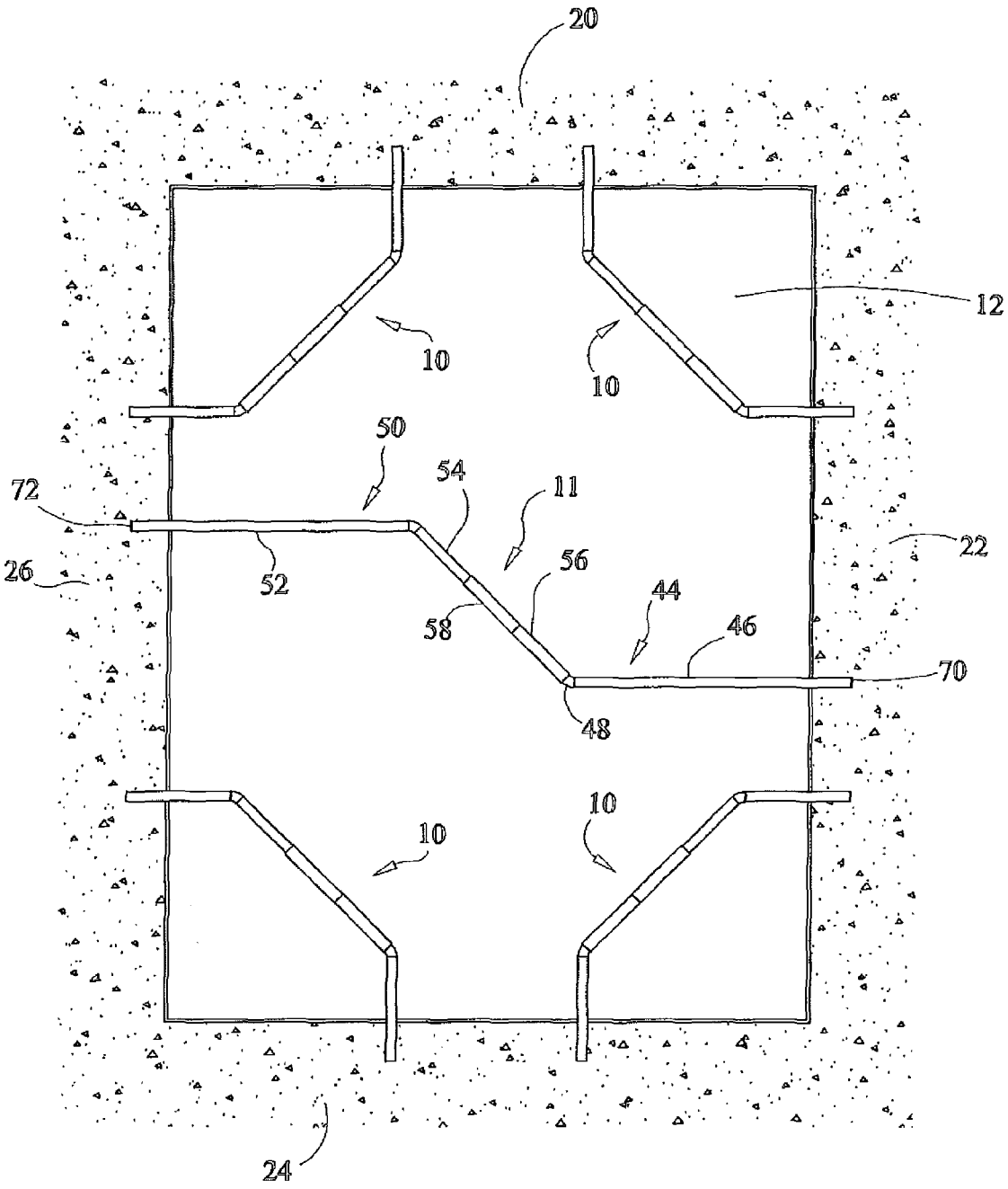
FIG. 1 is an elevated, front view of a window opening which is covered by a panel held in place by fastener devices of this invention.

Referring now to the Figs., a number of fastener devices 10 and a fastener device 11 are depicted in position to releasably secure a panel 12 over a window 14. The window 14 is held within a frame 16 which, in turn, is mounted within an opening formed in a structure such as a building (not shown). The opening is defined by walls 20, 22, 24 and 26, as shown in FIG. 1. The panel 12 may be formed of Lexan or other strong, relatively lightweight transparent material, or a structural material such as a sheet of plywood. As discussed below, the particular application of securing a panel 12 within an opening formed in a building to protect a window 14 and the contents of the building is but one of many uses of the fastener device 10 herein, and is in no way intended to limit the scope of this invention.

Figure 2:
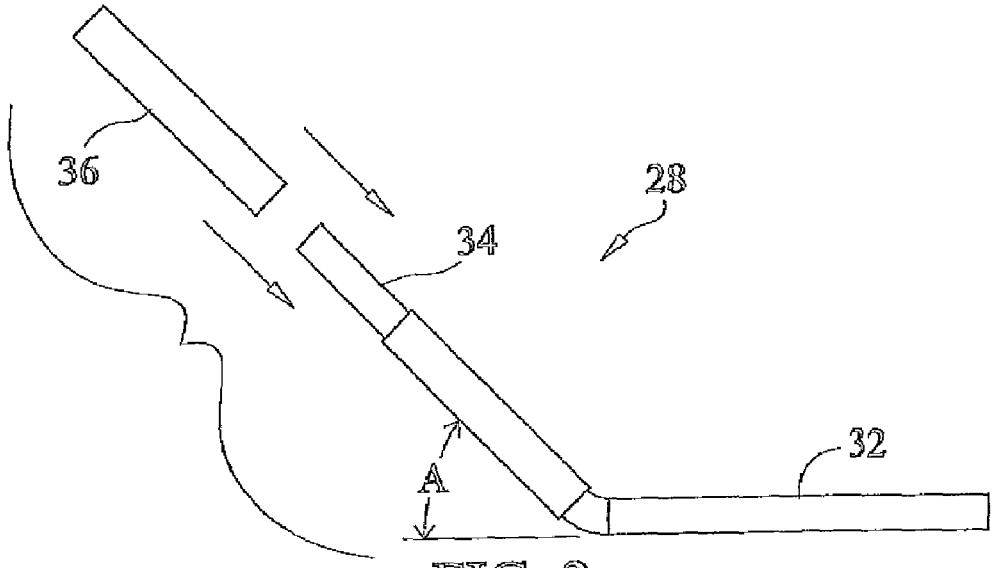
FIG. 2 is an enlarged, perspective view of a fastening member herein.
Figure 3:
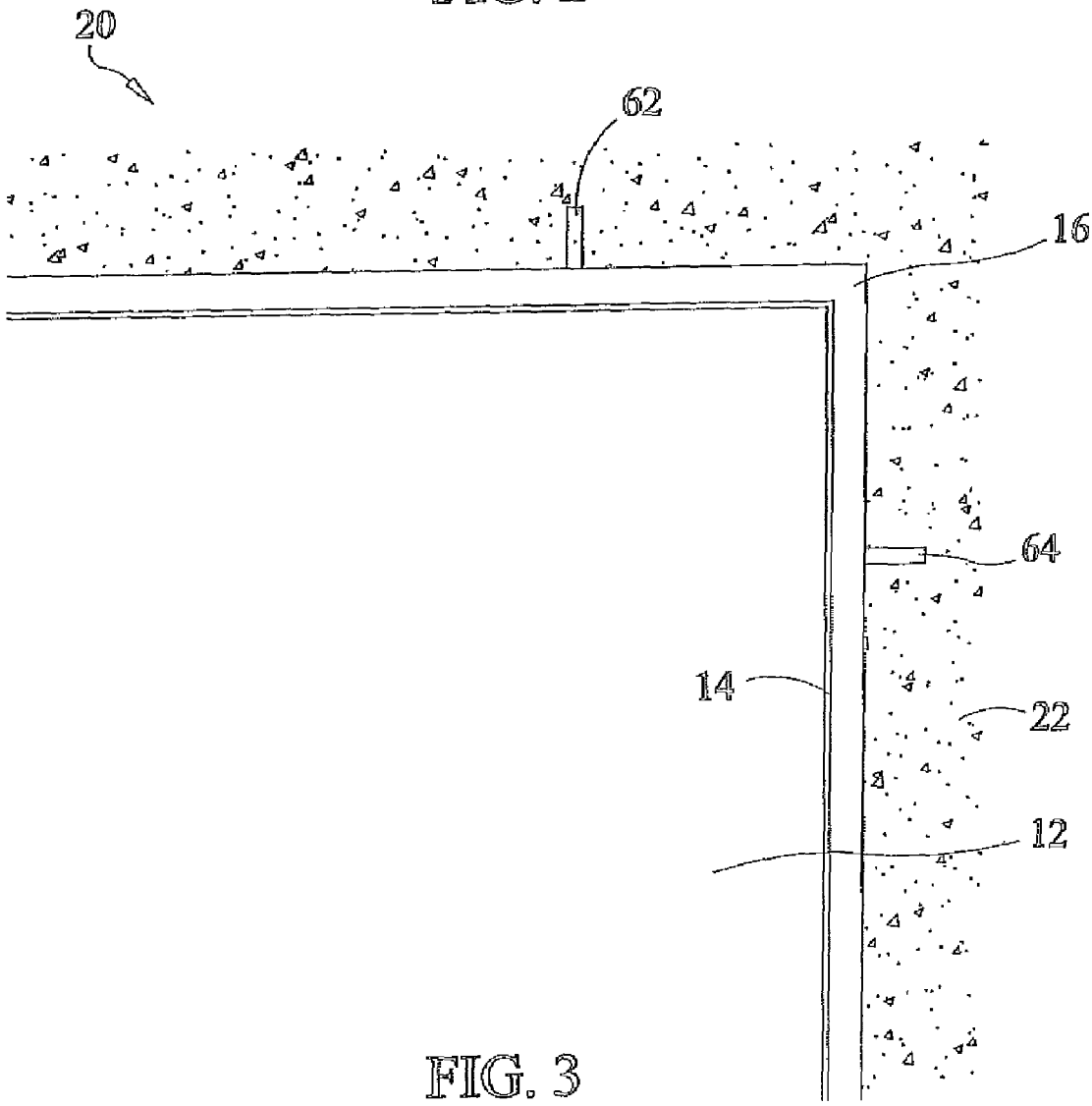
FIG. 3 is a view similar to FIG. 1 except showing only a corner of the window opening, with the fastener device removed.
Figure 6:
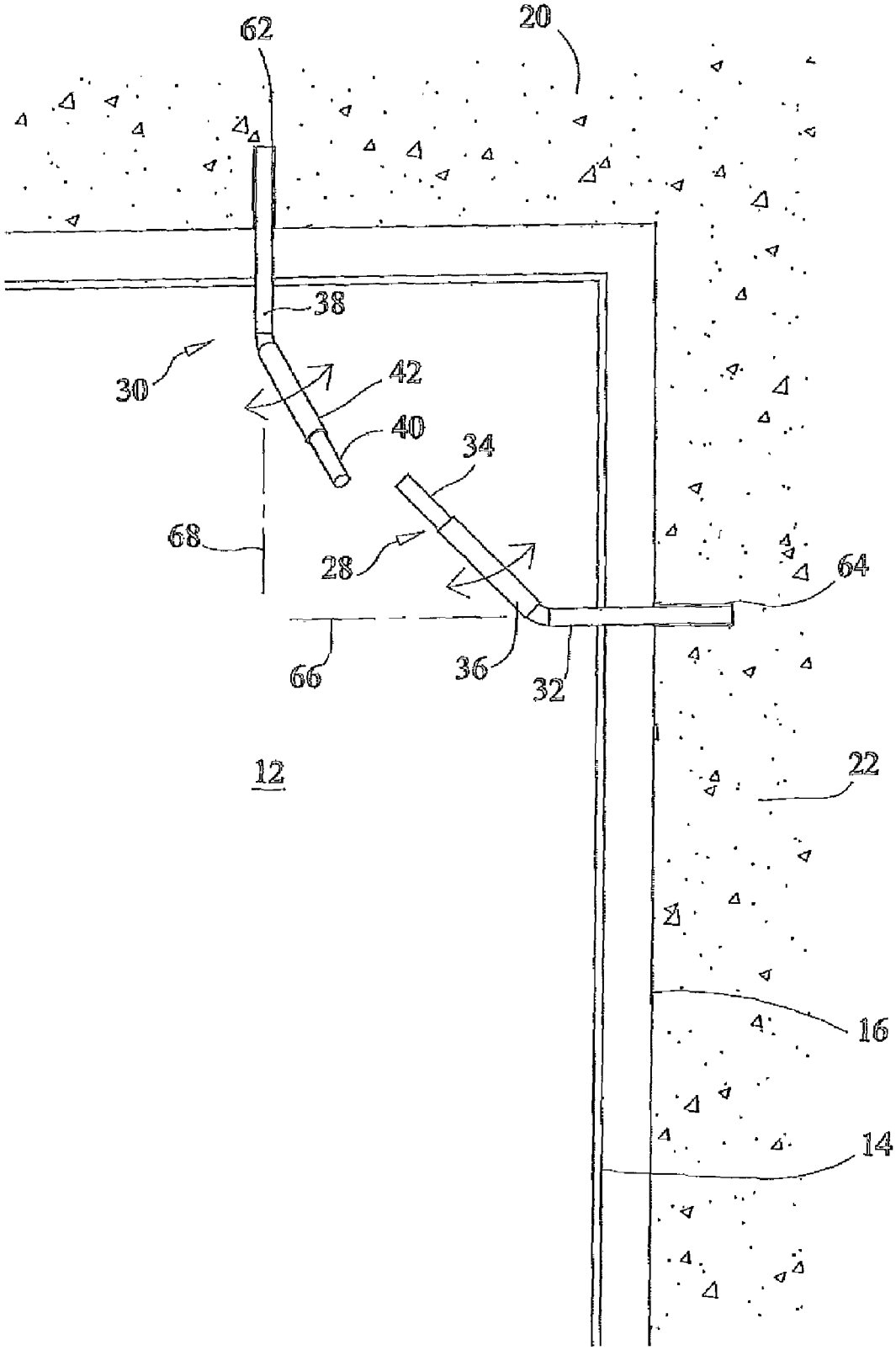
FIG. 6 is view similar to FIGS. 4 and 5 illustrating how the two fastening members may be move relative to one another to align the legs thereof.

Considering initially the fastener devices 10 located at each corner of the panel 12, as best seen in FIGS. 2 and 6 each fastener device 10 comprises at least two fastening members 28 and 30. The fastening member 28 comprises cylindrical-shaped rod, preferably formed of metal or other rigid material, which is bent at the middle to form a first leg 32 and a second leg 34. The legs 32 and 34 are disposed relative to one another at an angle of 45° in this embodiment, although other angular orientations may be employed as described in connection with a discussion of FIG. 8 below. The 45° angle between the legs 32 and 34 is measured as shown in FIG. 2, and depicted by the angle "A" in the drawings. The leg 34 of fastening member 28 receives a coupling element 36 in the form of a hollow, cylindrical-shaped sleeve having an inner diameter slightly larger than the outer diameter of the leg 34. In the presently preferred embodiment, the length of the coupling element 36 is approximately two-thirds of the length of the leg 34. Further, an o-ring or other clip (not shown) may be employed to retain the coupling element 36 in place along the leg 34 when the fastening member 28 is not in use.

In the embodiment of this invention shown in FIGS. 1-7, the fastening members 28 and 30 are identical to one another, and therefore the description of fastening member 28 above applies to the fastening member 30. Preferably, the fastening member 30 comprises a third leg 38 and a fourth leg 40, oriented at a 45° angle relative to one another, with a coupling element 42 fitted over the fourth leg 40. As with the fastening member 28, the length of coupling element 42 is preferably two-thirds of the length of the fourth leg 40.

It is contemplated that the size and dimensions of the fastening members 28 and 30 forming the fastener device 10 may be varied to accommodate the requirements of a particular application. For example, the diameter of the rod forming the legs 32, 34 of fastening member 28 and the legs 38, 40 of the fastening member 30 may be widely varied depending on the anticipated forces applied to the panel 12 and other factors. The inner diameter of the coupling elements 36 and 42 would be correspondingly varied, and the wall thickness of same could be altered, as desired, to provide added strength and rigidity. Additionally, the length of the legs 32, 34 and 38, 40 of respective fastening member 28 and 30 could be varied to account for the size of a panel 12 to be secured in place. As shown in FIG. 1, and discussed in more detail below in connection with a description of how the fastener devices 10 are installed, the fastener devices 10 at the four corners of the panel 12 extend part way onto the surface of the panel 12. As the size of the panel 12 increases, it may be desirable to extend the fastener device 10 further onto the panel 12, e.g. at least in the same proportion as depicted in FIG. 1, thus necessitating an increase in the length of the legs 32, 34 of fastening member 28 and the legs 38, 40 of fastening member 30.

An example of how a fastener device 10 may be altered in dimension is shown in FIG. 1 in the form of a fastener device 11. The fastener device 11 comprises a fastening member 44 having a first leg 46 connected to a second leg 48. The first leg 46 is much longer than the second leg 48 to allow the fastening member 44 to extend to the center of the panel 12. Similarly, the fastener device 11 includes a fastening member 50 having a third leg 52 connected to a shorter, fourth leg 54. A coupling member 56 is received by the second leg 48 of fastening member 44, and the fourth leg 54 of fastening member 50 receives a coupling member 58. The fastening members 44 and 50, and the coupling elements 56 and 58, may be formed of the same materials and have the same structural relationships to one another as described in connection with the fastening members 28 and 30 of fastener device 10.

Installation of the fastener device 10 at the top right-hand corner of the panel 12 is shown in FIGS. 3-7. It should be understood that the fastener device 10 is installed in the same manner at the other corners of the panel 12, and the fastener device 11 is installed in the center of the panel 12 in the same way. Initially, a hole 62 is drilled or otherwise formed in the wall 20 of the building, and a second hole 64 is formed in the wall 22. Preferably, the holes 62 and 64 extend at a 90° angle to the surface of walls 20, 22, which intersect one another at a 90° angle. A jig or other device (not shown) may be provided to locate the position of holes 62, 64 along the walls 20 and 22, respectively, consistent with the dimensions of the fastening members 28 and 30, as will become apparent below.

Figure 4:
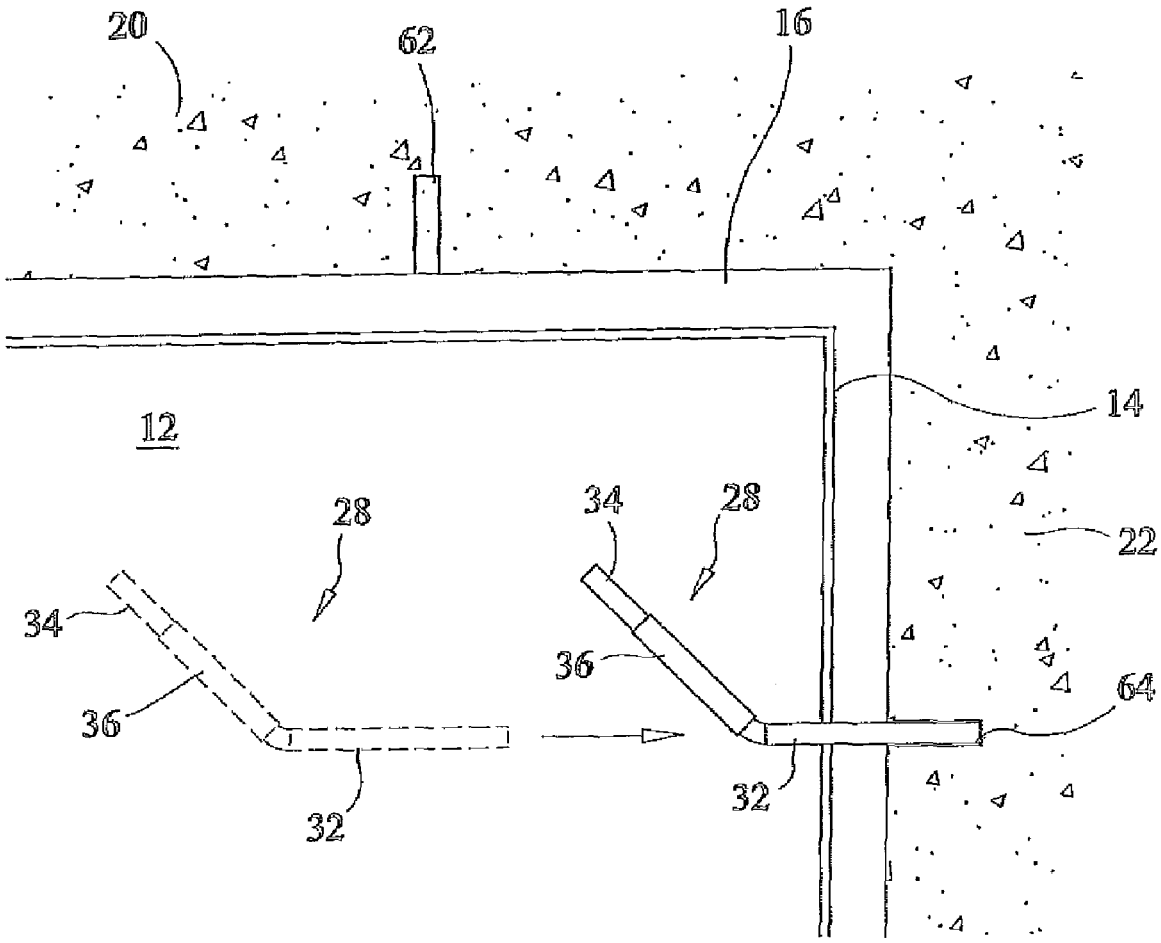
FIG. 4 is a view similar to FIG. 3 except with a fastening member being inserted into a hole formed in the window frame and surrounding structure.

As seen in FIG. 4, the first leg 32 of fastening member 28 is inserted into the hole 62. It is contemplated that the interior of hole 64 could be provided with a liner or the like (not shown) to receive and engage the first leg 32, but the interior dimension of the hole 64 and liner, if any, should be chosen to permit rotation of the fastening member 28 with respect to a pivot axis 66, e.g. the longitudinal axis of the first leg 32. See FIG. 6. Additionally, the leg 32 is shown in the Figs. as extending into the wall 22 of the building and terminating within such wall 22. It is contemplated that the first leg 32 may extend through the wall 22, in which case the first leg 32 may be secured in place, after installation has been completed, by a clip, or by a nut if the end of the first leg 32 is threaded (not shown).

With the first leg 32 in position in the hole 64, the coupling member 36 carried by the second leg 34 of fastening member 28 is preferably moved into abutment with the juncture of first and second legs 32, 34. Because the coupling element 36 is approximately two-thirds of the length of the second leg 34, about one-third of its length is uncovered by the coupling element 36.

Figure 5:
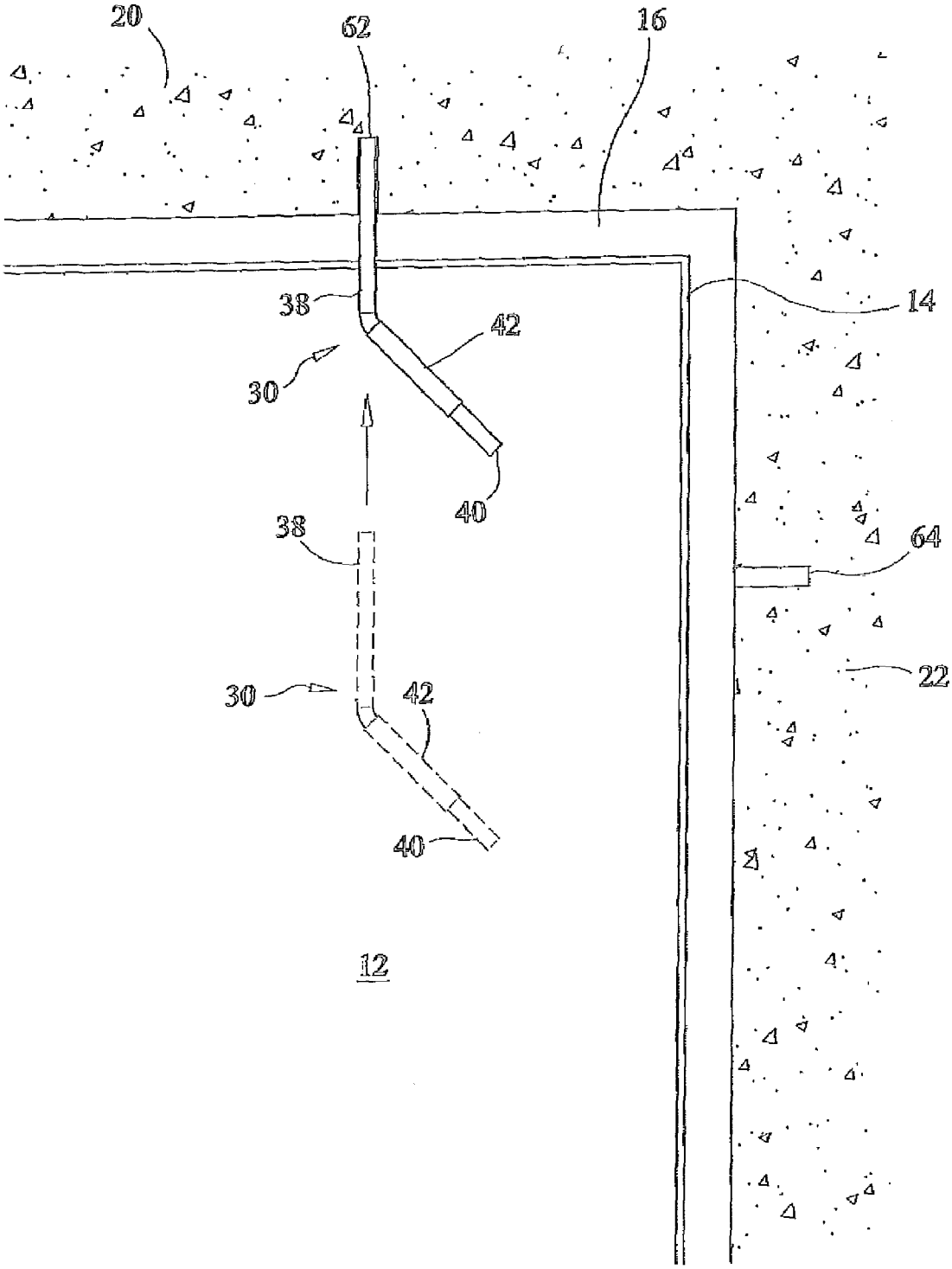
FIG. 5 is a view similar to FIG. 4 except depicting the other fastening member being inserted into place.

As illustrated in FIG. 5, the fastening member 30 is positioned relative to the panel 12 in the same manner as fastening member 28. The third leg 38 of fastening member 30 is inserted into the hole 62 in wall 20 of the building in such as way as to permit rotation of the fastening member 30 relative to the longitudinal axis of the third leg 38, e.g. pivot axis 68 as depicted in FIG. 6.

Figure 7:
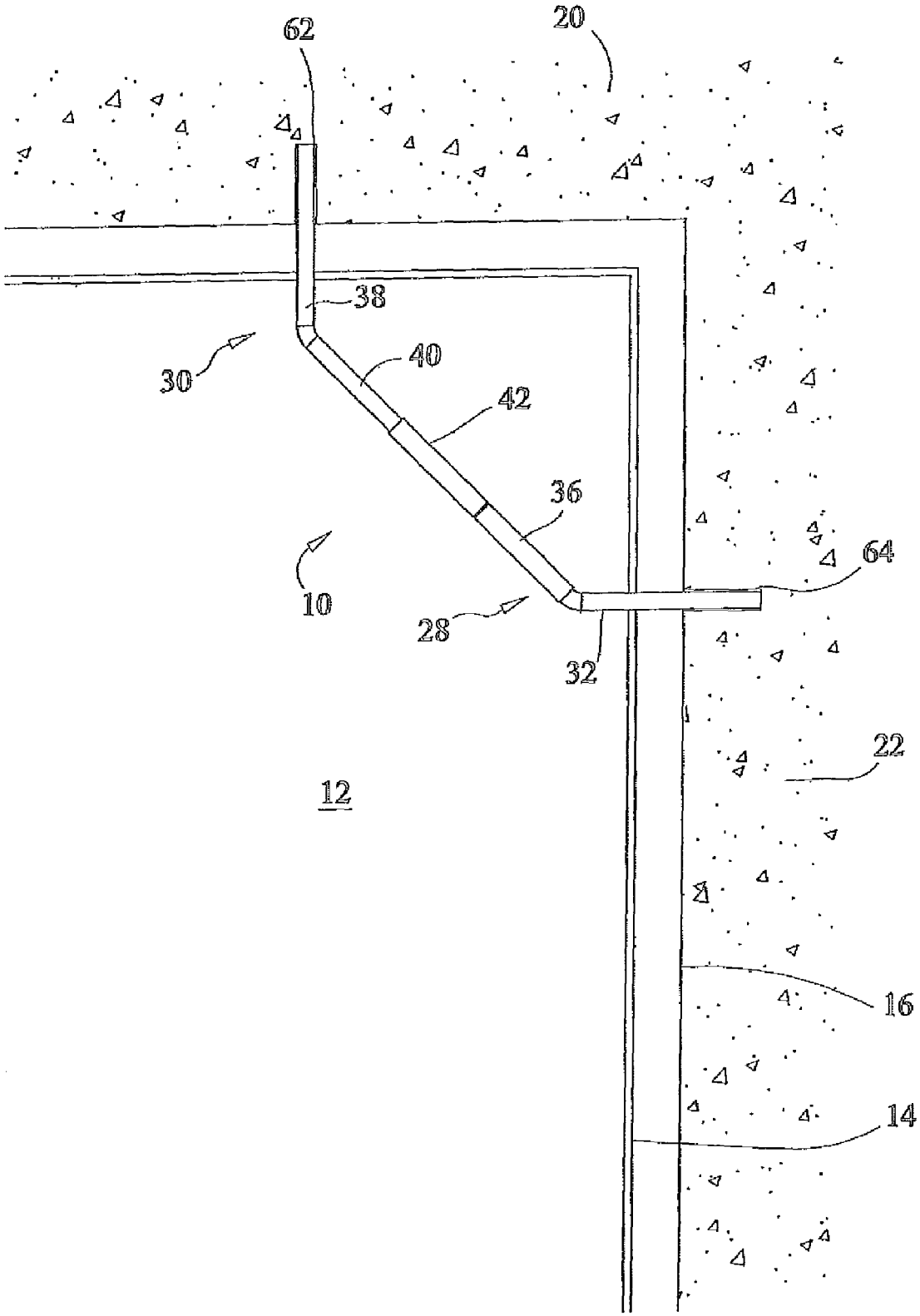
FIG. 7 is a view similar to FIG. 6, except with the fastening members aligned and the coupling elements in the locked position.

With the first leg 32 of fastening member 28 positioned within the hole 64 in wall 22, and the third leg 38 of fastening member 30 located within the hole 62 in wall 20, the next step in the installation process is shown in FIGS. 6 and 7. One or both of the fastening members 28 and 30 is rotated about their respective pivot axes 66 and 68 so that the second leg 34 of fastening member 28 aligns with the fourth leg 40 of the fastening member 30. Although not wishing to be confined to a particular theory of operation of the present invention, it is believed that the end of one and/or both legs 34 and 40 undergoes a trochoidal motion while the fastening members 28 and 30 are being manipulated, as roughly depicted by the arrows in FIG. 6. In any event, due to the dimensions of the legs 32, 34 of fastening member 28 and the legs 38, 40 of fastening member 30, the angle of such legs 32, 34 and 38, 40 relative to one another, and, the location of holes 62 and 64, movement of the fastening members 28 and 30 about the pivot axes 66 and 68, respectfully, permits the ends of the second leg 34 and fourth leg 40 to align with one another. In this position, the coupling element 42 carried by the fourth leg 40 of fastening member 30 may be slid onto the exposed portion of the second leg 34 of fastening member 28 and into abutment with the coupling element 36 carried by the second leg 34. See FIG. 7. Because each of the coupling elements 36 and 42 are two-thirds of the length of legs 34 and 38, respectfully, when the coupling element 42 abuts the coupling element 36 half of its length extends along the second leg 34 of fastening member 28 and the other half extends along the fourth leg 40 of the fastening member 30. This effectively and releasably connects the two fastening members 28 and 30 together, with a substantial portion of their respective legs 32, 34 and 38, 40 extending into engagement with or in close proximity to the panel 12 thus retaining it in place against the window 14. It is contemplated that the coupling element 42 may be retained in place against the coupling element 36 under the influence of gravity, but clips, O-rings or other means may be employed to engage the free end of the coupling element 42 to maintain it in position.

As noted above, the same installation procedure employed for the fastener devices 10 may be used to install the fastener device 11. The first leg 46 of fastening member 44 is inserted into a hole 70 formed in the wall 22, and the third leg 52 of the fastening member 50 is inserted into a hole 72 formed in the wall 26. The fastening members 44 and 50, and their respective coupling elements 56, 58, are manipulated as described above in connection with a discussion of fastener device 10 to releasably secure the fastener device 11 across approximately the middle of the panel 12, as shown in FIG. 1.

An important aspect of this invention is that the installation process for the fastener devices 10 and 11 may be performed by hand, without any tools except potentially for the formation of holes in the walls 20-26 of the structure 18. Moreover, the fastener devices 10 and 11 may be removed by hand, using the reverse steps described above. In addition to the installation efficiencies, the fastener devices 10 and 11 are easy to fabricate, inexpensive and highly effective.

It is noted from the Figs. that the opening in the building defined by walls 20-26 is generally rectangular, and the walls 20-26 intersect one another at an included angle of 90°. In the embodiment of FIGS. 1-7, the fastener devices 10 and 11 include fastening members 28 and 30, or 44 and 50, whose legs are each oriented at an angle of 45° relative to one another. The cumulative angle formed by such legs, e.g. the sum of the angles, is therefore the same as the 90° included angle between the intersecting walls 20-26.

Figure 8:
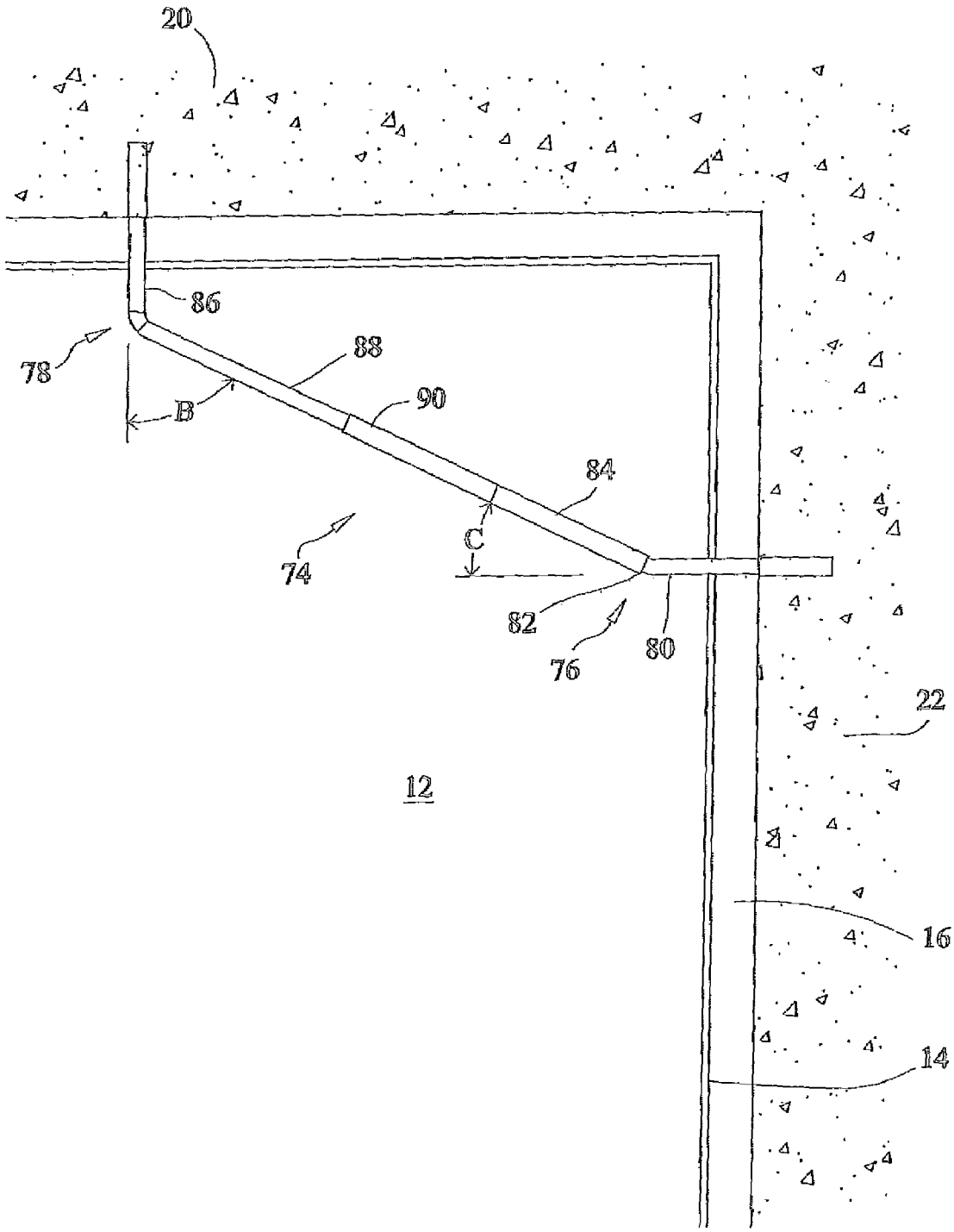
FIG. 8 is a view similar to FIG. 7 except depicting an alternative embodiment of the fastening members of this invention.

It should be understood that the angle between the legs of fastening members 28, 30, or 44, 50, need not be the same so long as they add up to the included angle between the walls 20-26. An example of such an alternative construction of the fastener device of this invention is shown in FIG. 8. In this embodiment, a fastener device 74 is illustrated having a fastening member 76 and a fastening member 78. The fastening member 76 has a first leg 80 connected to a second leg 82, and these legs are oriented relative to one another at an angle "C", as depicted in FIG. 8, of approximately 24°. A coupling element 84 is carried by the first leg 80 of fastening member 74. The fastening member 78 includes a third leg 86 and a fourth leg 88 which form an angle "B," as illustrated in FIG. 8, of about 66°. The fourth leg 88 of fastening member 76 carries a coupling element 90. The fastening members 74 and 76 are connected to the walls 20 and 22 of the building, and releasably connected to one another, in the same manner as described above in connection with a discussion of the embodiment of FIGS. 1-7. The principal difference between the fastener device 74 and fastener devices 10 is the angles which are formed between the legs of the fastening members 76, 78 compared to the fastening members 28, 30 or 44, 50, e.g. 24° and 66° vs. 45° and 45°. Nevertheless, the cumulative angle formed by the fastening members 76 and 78 is equal to the included angle between two intersecting walls 20 and 22.

It is contemplated that a variety of different angles between fastening members employed in the fastener device of this invention may be utilized, depending on the requirements of a particular application, so long as two objectives are satisfied. First, the cumulative angle formed by the legs of each fastening member of a fastener device should be substantially equal to the included angle formed by the walls or other intersecting surfaces defining an opening within which an object, such as panel 12, is to be secured and to which the fastening members are to be mounted. The walls 20-26 depicted in FIGS. 1-8 intersect one another at a right angle. However, an opening in a building or other structure may define walls forming angles greater or less than 90°, e.g. a triangular, hexagon, octagon or other shape. In those applications, the angles between the legs of the fastening members are chosen to cumulatively substantially equal the included angle between the intersecting surfaces within which they are mounted. For example, in the case of a triangular-shaped opening having equal angles, the cumulative angle formed by the legs of one fastening element and the legs of another fastening element equals approximately 60°.

The second objective is to ensure, to the extent practicable, that one leg of each of the fastening members is inserted at a right angle into the wall or other surface defined by the opening. This facilitates drilling or other operations employed to form holes in the surfaces. Further, with a leg of each fastening member oriented at a right angle to the surface defined by the opening, forces acting against the object held in the opening (such as panel 12) tend to be applied to the fastening members in shear, i.e. perpendicularly to the legs inserted in the surfaces, rather than in a direction tending to pull the legs out of such surfaces. Stability of the panel 12 or other object secured within the opening is therefore enhanced.

Figure 9:
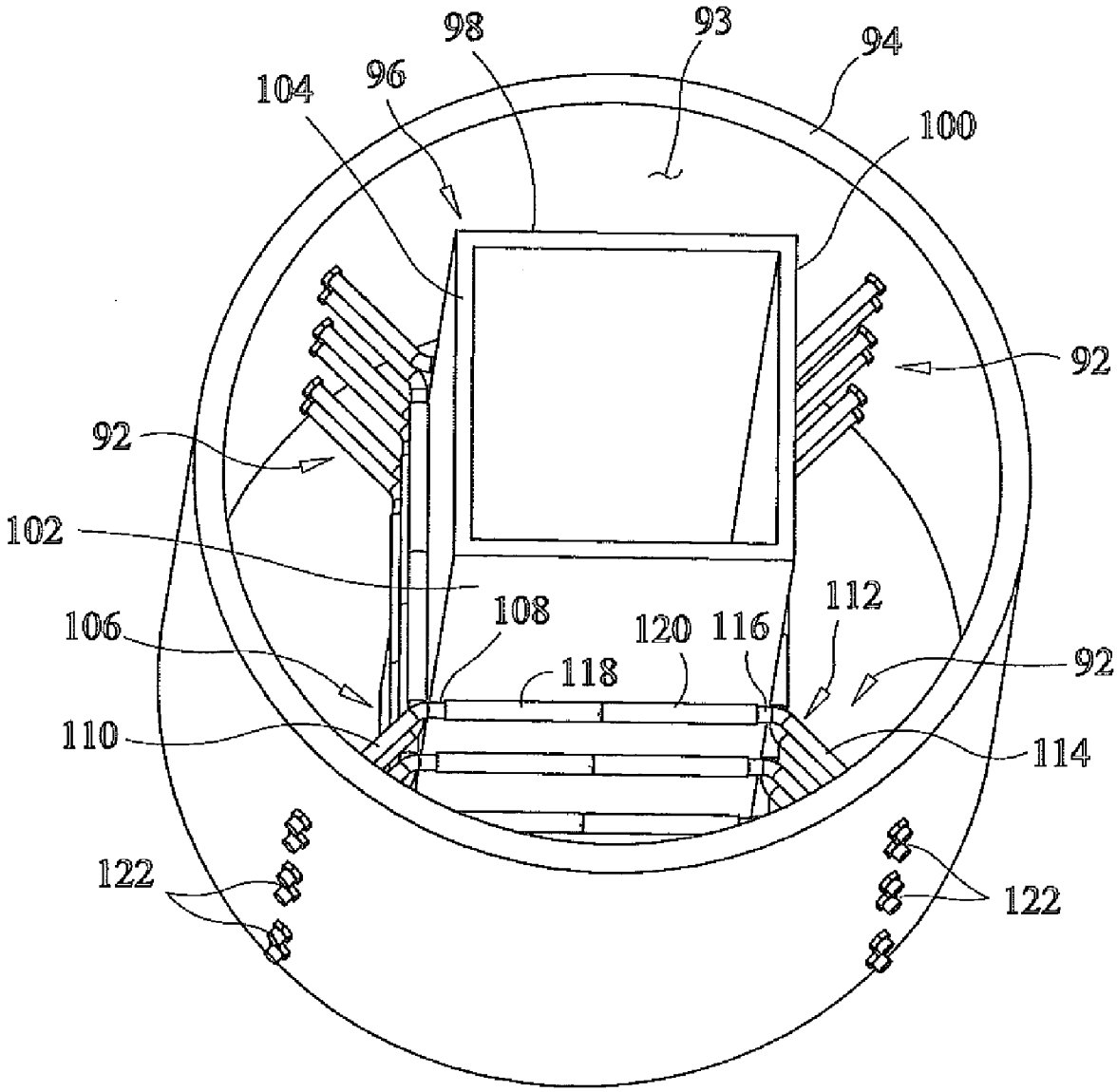
FIG. 9 is a perspective view of the fastener device of this invention employed in an application wherein a bearing is held in place within an opening formed in a shaft.

The preceding discussion has focused on securing a panel 12 within an opening in a structure, e.g. a window 14 formed in a building, wherein the opening is defined by surfaces that intersect one another. The walls 20-26 define surfaces that intersect one another at a right angle. Referring now to FIG. 9, a fastener device 92 according to this invention is illustrated for use in securing an object within an opening with no intersecting surfaces, e.g. an annular opening 93 defined by a generally cylindrical-shaped wall 94. As schematically depicted in FIG. 9, a square-shaped shaft 96 having walls 98, 100, 102 and 104 is supported by a series of fastener devices 92, at least three of which engage each wall 98-104. Each fastener device 92 comprises a fastening member 106 having a leg 108 connected to a leg 110, and a fastening member 112 having interconnected legs 114 and 116. The leg 108 of fastening member 106 carries a coupling element 118, while the leg 116 of fastening member 112 carries a coupling element 120. As viewed along the bottom portion of FIG. 9, the leg 110 of each fastening member 106 is inserted through the wall 94 and may be secured in place by a nut 122. Similarly, the leg 114 of each fastening member 112 extends through the wall 94 at a location spaced from the leg 108 and may be fixed in place by a nut 122.

The fastening members 106 and 112 may be manipulated relative to one another, in the same manner as described in connection with the embodiment of FIGS. 1-7, in order to align their respective legs 108 and 116. The nuts 122 are loosened at this stage of the assembly procedure to permit rotation of the fastening members 106 and 112 with respect to the wall 94. Depending upon the dimension of the object to be supported within a given opening, e.g. in the case of FIG. 9 the width of the walls 98-104 of shaft 96, the length of the aligning legs 108 and 116 may be longer than that of the legs 110 and 114 so that one of the coupling elements 118 or 120 may be extended from one leg 108 or 116 onto the other to releasably connect the fastening members 106 and 112 together. In that instance, the coupling elements 118 and 120 are made proportionately longer, e.g. approximately two-thirds of the longer length of the aligning legs 110 and 114.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof.

For example, in each of the embodiments of this invention, the fastening elements are releasably connected to one another by abutting the coupling element carried on one leg with the coupling element on the aligning leg. It is contemplated that one of the coupling elements could be removed and replaced by a stop affixed to the leg of a fastening element such that the coupling element remaining on one of the aligning leg contacts the stop in order to position it half-and-half on each of the aligning legs.

Therefore, it is intended that the invention not be limited to the particular embodiment disclosed as the best mode contemplated for carrying out this invention, but that the invention will include all embodiments falling within the scope of the appended claims.

What is claimed is:

1. Apparatus for securing an object with respect to an opening at least partially defined by a first surface and second surface that intersect one another, comprising:

a first fastening member having a first leg connected at an offset angle to a second leg, said first leg being inserted into said first surface;

a coupling element movable along said second leg of said first fastening member;

a second fastening member having a third leg connected at an offset angle to a fourth leg, said third leg being inserted into said second surface;

said first and second fastening members being movable relative to one another with said first leg of said first fastening member and said third leg of said second fastening member inserted within respective first and second surfaces, whereby said second leg of said first fastening member and said fourth leg of said second fastening member become oriented relative to one another so that said coupling element may be positioned to engage said second leg and said fourth leg to thereby releasably connect said first and second fastening members together in position to secure the object between said first and second fastening members and the opening.

2. The apparatus of claim 1 in which said first and second surfaces form an included angle between them, said first and second legs of said first fastening member being oriented at a first angle relative to one another, said third and fourth legs of said second fastening member being oriented at a second angle relative to one another, said first and second angles combined being substantially equal to said included angle.

3. The apparatus of claim 2 in which said coupling element is a sleeve.

4. The apparatus of claim 1 in which said first and second fastening members are movable relative to one another so that said second leg of said first fastening member aligns with said fourth leg of said second fastening member.

5. The apparatus of claim 1 in which said first leg of said first fastening member and said third leg of said second fastening member are inserted substantially perpendicularly into the first and second surfaces, respectively.

6. The apparatus of claim 1 in which said first and second fastening members undergo trochoidal movement to reach a relative position for engagement of said coupling element with each of said second and fourth legs.

7. Apparatus for securing an object with respect to an opening at least partially defined by a first surface and second surface that meet one another and form an included angle between them, comprising:

a first fastening member having a first leg connected to a second leg, said first and second legs being oriented at a first angle relative to one another, said first leg being inserted into said first surface;

a first coupling element movable along said second leg of said first fastening member;

a second fastening member having a third leg connected to a fourth leg, said third and fourth legs being oriented at a second angle relative to one another, said first angle and said second angle combined being substantially equal to the included angle between the first and second surface, said third leg being inserted into said second surface;

said first and second fastening members being movable relative to one another, with said first and third legs inserted within respective first and second surfaces, so that said second leg of said first fastening member aligns with said fourth leg of said second fastening member, said first coupling element being movable onto at least a portion of said fourth leg while at least a portion of said first coupling element remains on said second leg to releasably connect said first and second fastening members together in position to secure the object between said first and second fastening members and the opening.

8. The apparatus of claim 7 further including a second coupling element movable along said fourth leg of said second fastening member.

9. The apparatus of claim 8 in which each of said second and fourth legs has a length, said first coupling element having a length which is less than said length of said second leg and said second coupling element having a length which is less than said length of said fourth leg.

10. The apparatus of claim 9 in which said length of said first coupling element is about two-thirds of said length of said second leg.

11. The apparatus of claim 9 in which said length of said second coupling element is about two-thirds of said length of said fourth leg.

12. The apparatus of claim 9 in which said first and second coupling elements abut one another when said second leg of said first fastening member and said fourth leg of said second fastening member align with one another.

13. The apparatus of claim 12 in which said first coupling element abuts said second coupling element upon movement onto said fourth leg, approximately one-half of said length of said first coupling element extending onto said fourth leg of said second fastening member and approximately one-half of said first coupling remaining along said second leg of said first fastening member.

14. The apparatus of claim 7 in which said first leg of said first fastening member is adapted to be inserted substantially perpendicularly into said first surface.

15. The apparatus of claim 7 in which said third leg of said second fastening member is adapted to be inserted substantially perpendicularly into said second surface.

16. The apparatus of claim 7 in which said first and second legs of said first fastening member are the same length.

17. The apparatus of claim 16 in which said third and fourth legs of said second fastening member are the same length.

18. The apparatus of claim 17 in which the length of said first and second legs is the same as the length of said third and fourth legs.

19. The apparatus of claim 7 in which said first and second legs of said first fastening member are of different length, and said third and fourth legs of said second fastening member are of different length.

20. Apparatus for securing an object with respect to an opening formed in a structure and defined by a wall, comprising:

a first fastening member having a first leg connected to a second leg, said first leg being inserted into the wall of the structure at a first location;

at least one coupling element carried by at least one of said first and second fastening members;

a second fastening member having a third leg connected to a fourth leg, said third leg being inserted into the wall of the structure at a second location spaced from said first location;

said first and second fastening members being movable relative to one another with said first leg of said first fastening member and said third leg of said second fastening member inserted within the wall of the structure, whereby said second leg of said first fastening member becomes oriented with respect to said fourth leg of said second fastening member so that said at least one coupling element may be positioned to engage said second leg and said fourth leg to thereby releasably connect said first and second fastening members together in position to secure the object between said first and second fastening members and the opening in the structure.

21. The apparatus of claim 20 in which the opening in the structure is annular.

22. The apparatus of claim 20 in which the opening in the structure has at least two surfaces which intersect one another.

23. The apparatus of claim 20 in which said at least one coupling element comprises a first coupling element carried by said second leg of said first fastening member, and a second coupling element carried by said fourth leg of said second fastening member.

24. The apparatus of claim 23 in which said first and second coupling elements abut one another when releasably connecting said first and second fastening members so that at least one of said first and second coupling elements extends onto a respective second or fourth leg of said first and second fastening members.

25. The apparatus of claim 20 in which said first and second fastening members contact the object when releasably connected together to retain the object in position within the opening in the structure.

26. Apparatus for securing a panel over a window or door mounted within an opening in a building, comprising:

a first fastening member having a first leg connected at an offset angle to a second leg, said first leg being inserted into a first wall formed by the opening in the building;

a coupling element movable along said second leg of said first fastening member;

a second fastening member having a third leg connected at an offset angle to a fourth leg, said third leg being inserted into a second wall formed by the opening in the building;

said first and second fastening members being movable relative to one another with said first leg of said first fastening member and said third leg of said second fastening member inserted within respective first and second walls, whereby said second leg of said first fastening member and said fourth leg of said second fastening member become oriented relative to one another so that said coupling element may be positioned to engage said second leg and said fourth leg to thereby releasably connect said first and second fastening members together in position to secure the panel between the first and second fastening members and the window or door in the building.

27. The apparatus of claim 26 further including a second coupling element movable along said fourth leg of said second fastening member.

28. The apparatus of claim 27 in which each of said second and fourth legs has a length, said first coupling element having a length which is less than said length of said second leg and said second coupling element having a length which is less than said length of said fourth leg.

29. The apparatus of claim 27 in which said length of said first coupling element is about two-thirds of said length of said second leg.

30. The apparatus of claim 27 in which said length of said second coupling element is about two-thirds of said length of said fourth leg.

31. The apparatus of claim 27 in which said first and second coupling elements abut one another when said second leg of said first fastening member and said fourth leg of said second fastening member align with one another.

32. The apparatus of claim 31 in which said first coupling element abuts said second coupling element upon movement onto said fourth leg, approximately one-half of said length of said first coupling element extending onto said fourth leg of said second fastening member and approximately one-half of said first coupling remains along said second leg of said first fastening member.

33. The apparatus of claim 26 in which said first leg of said first fastening member is adapted to be inserted substantially perpendicularly into said first wall.

34. The apparatus of claim 26 in which said third leg of said second fastening member is adapted to be inserted substantially perpendicularly into said second wall.

35. The apparatus of claim 26 in which said first leg, second leg, third leg and fourth leg are the same length.

36. The apparatus of claim 26 in which said first and second legs are of different length.

37. The apparatus of claim 26 in which said third and fourth legs are of different length.

38. The apparatus of claim 26 in which said first and second walls form an included angle between them, said first and second legs of said first fastening member being oriented at a first angle relative to one another, said third and fourth legs of said second fastening member being oriented at a second angle relative to one another, said first and second angles combined being substantially equal to said included angle.

* * * * *